United States Patent [19]

Camboulives

[11] Patent Number: 4,466,776

[45] Date of Patent: Aug. 21, 1984

[54] AXIAL LOCKING DEVICE FOR TURBOMACHINE BLADES

[75] Inventor: André A. M. L. Camboulives, Savigny Sur Orge, France

[73] Assignee: S.N.F.C.M.A., Paris, France

[21] Appl. No.: 457,941

[22] Filed: Jan. 14, 1983

[30] Foreign Application Priority Data

Jan. 14, 1982 [FR] France ..... 8200496

[51] Int. Cl.[3] ..... F01D 5/32

[52] U.S. Cl. ..... 416/221; 416/220 R; 416/212 R

[58] Field of Search ..... 416/212 R, 220 R, 221, 416/218

[56] References Cited

U.S. PATENT DOCUMENTS

| | | | |
|---|---|---|---|
| 2,658,718 | 11/1953 | Walker | 416/220 |
| 2,667,327 | 1/1954 | Hardigg | 416/221 |
| 2,807,436 | 9/1957 | Hockert | 416/220 |
| 3,023,998 | 3/1962 | Sanderson | 415/170 R |
| 3,297,302 | 1/1967 | Spears, Jr. | 416/220 |
| 3,341,174 | 9/1967 | Manning | 416/220 |
| 3,508,844 | 4/1970 | Le Blanc | 416/221 |
| 4,349,318 | 9/1982 | Libertini et al. | 416/220 R |
| 4,389,161 | 6/1983 | Brumen | 416/220 R |

FOREIGN PATENT DOCUMENTS

| | | | |
|---|---|---|---|
| 17350 | 12/1956 | Fed. Rep. of Germany | 416/220 |
| 375059 | 6/1906 | France | 416/220 |
| 250728 | 7/1948 | Switzerland | 416/221 |
| 317345 | 12/1956 | Switzerland | 416/220 |
| 894704 | 4/1962 | United Kingdom | 416/220 |
| 948722 | 2/1964 | United Kingdom | 416/221 |

*Primary Examiner*—Stephen Marcus
*Assistant Examiner*—Kwon John
*Attorney, Agent, or Firm*—Oblon, Fisher, Spivak, McClelland & Maier

[57] ABSTRACT

The device is composed of a conical section located on the edge of the disk rim. The greatest radius of the conical section is at least equal to the radius of the circumference passing through the bottom of the axial grooves into which the blade roots are inserted. A groove is formed in the end of the lower part of the root, this groove having a right angle triangular section. A locking part has one face pressed against the bearing and two other faces against the sides of the groove in the root. A blade extending longitudinally in the locking part works together with a groove in the slot of the blade root to keep the locking part in place.

12 Claims, 3 Drawing Figures

AXIAL LOCKING DEVICE FOR TURBOMACHINE BLADES

BACKGROUND OF THE INVENTION

1. Field of the Invention

The invention concerns an axial locking device for turbomachine (i.e., turbine and compressor) blades, which radially locks the blades by their roots in axial grooves formed in the rim of the rotor disk and axially locks the blades by locking devices which work together with the blade roots and the rotor disk.

2. Description of the Prior Art

Many axial blade locking devices require rather complicated machining of either the rim or the blade shank and sometimes both. Generally notched teeth are positioned on the upper face of the disk and perpendicular to this face. Locking parts are positioned in the notches against the blade root to prevent axial movement.

French Pat. No. 1,037,572 describes a relatively simple device in which the blade root is extended upward by a collar in the body of which is machined, parallel to the face of the disk, a triangular asymmetrical notch. The rotor disk has an axial flange on its upper face. The upper lateral surface of the flange has an asymmetrical triangular notch which is the reverse of the one in the collar. When the blade is in place in its groove, a locking part is inserted in the space between the two notches. This space is approximately parallelepipedal in shape and is extended at each of its longitudinal ends by a thin part forming tongues that are folded toward the faces of the blade collar. Radial movement is prevented by the corresponding faces of the notches working together with the locking part.

However, the device of the French patent requires blades equipped with collars and a flanged rotor disk, which are expensive elements both in terms of machining and of weight. Moreover, the locking element, which is itself expensive, must be considered a destructible part because in order to withdraw a blade at least one of the folded tongues of the assembly must be unfolded. The possibility of failure of the locking part caused by successive folding and unfolding of at least one tongue make repeated use of the locking parts described in French Pat. No. 1.037,572 dangerous.

SUMMARY OF THE INVENTION

The present invention proposes to create, from blades without collars and from a conventional rotor disk, i.e., one which has no complicated attachment structure other than what is necessary for the axial support of the blades, a locking device which uses simple machined surfaces and which is less expensive in terms of spare parts for maintenance.

Indeed, the device according to the invention is composed of at least one conical support located on the edge of the rim of the rotor disk, with the greatest radius of the bearing at least equal to the radius of the circumference going through the bottom of the axial blade locking grooves. A slot is in the lower part and at one end of the blade shank on the side of the conical bearing, with the axis of the slot parallel to the plane of the disk. Locking devices including a locking part designed to work together with the blade shank slot and the conical bearing surface are positioned in the grooves of the blade root.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 3:
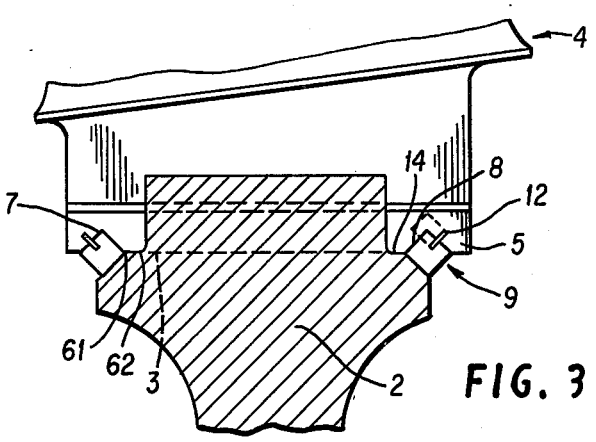
FIG. 3 is a radial section along line III—III of FIG. 1.

A turbine or compressor rotor disk 1 includes (FIG. 1) dovetailed axial support groove 3 on its rim 2, as is conventional. The blade 4 has a root 5 in a shape which complements that of the groove 3. According to the invention, a conical bearing surface 6 is machined on the edges of the rim 2. This bearing surface has, for example, in relation to the plane of the rotor disk, an angle on the order of 40° to 45°. The greatest radius 61 of the bearing is at least equal to the radius 62 of an imaginary circumferential line passing through the bottom of the axial blade locking grooves. The upper and lower ends of the blade roots extend axially from the groove 3 and overhang at least part of the conical bearing surface 6.

Figure 2:
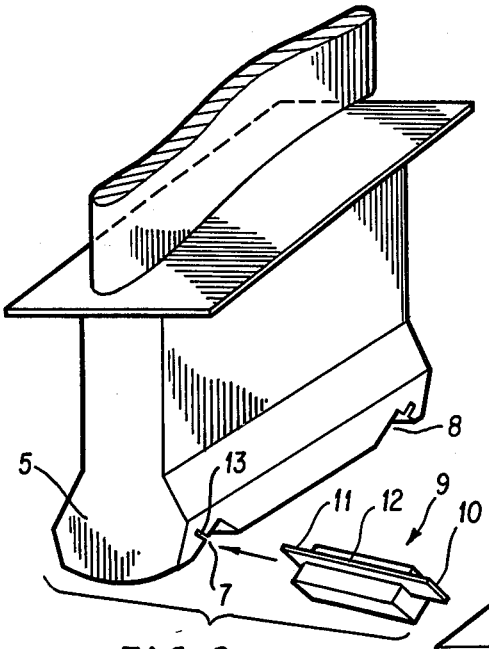
FIG. 2 shows in perspective a blade root and a locking part.

The lower part of the blade root 5 (FIG. 2) has in at least one of its ends a groove 7 or 8, the length of which is parallel to the plane of the rotor disk on the edge of which the blade is to be attached. This groove has a right angle section in the form of an isosceles right triangle of which one of the sides is parallel to a generatrix of the conical section 6 when the blade is inserted in the slot 3.

A locking part 9, in the form of a right angle parallelepiped, is inserted between the bearing 6 and the corresponding groove 7 or 8.

Figure 1:
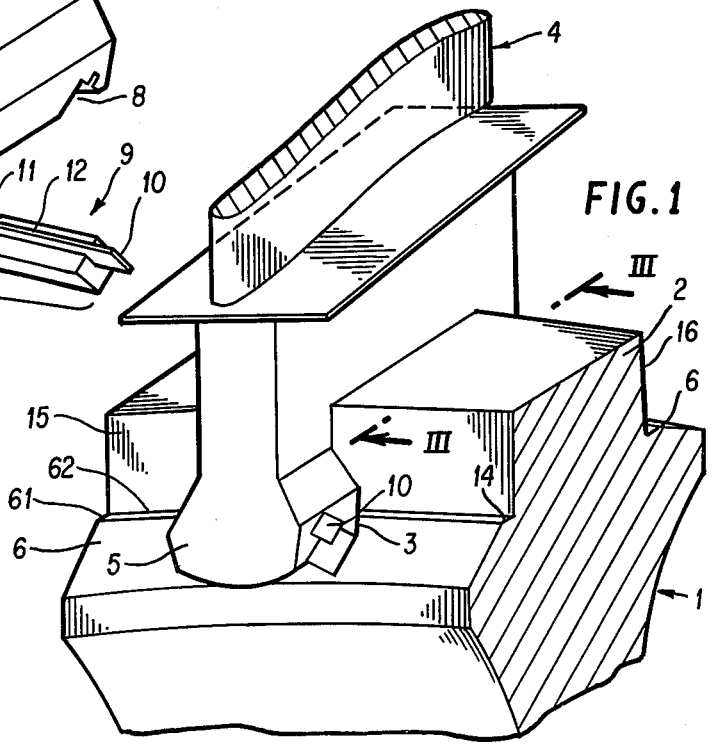
FIG. 1 shows in perspective a part of a rotor disk fitted with a blade locking device according to the invention.

According to the invention, a means for fixing the locking part, in the form of a metal blade 12 is held in a longitudinal slot of the locking part 9. Tongues 10 and 11 are formed by the tips of the blade 12 which is longer than the locking art. The blade is wider than the slot of locking part 9 is deep and consequently, the blade part which juts out is inserted in a corresponding slot 13 formed in the side of the groove 7 or 8 parallel to the bearing 6. The tongues 10 and 11 are folded against the blade shank as seen in FIGS. 1 and 3.

According to another embodiment, the slots in the locking part and in the groove 4 may be replaced by semicircular notches which form a cylindrical channel into which a strip is inserted, the ends of which are folded against the blade root and the locking part.

This blade or strip 12 has a two-fold purpose: to prevent longitudinal movement of the locking part and to keep the locking part in place against the bearing and the blade root when the blade is no longer subject to centrifugal force.

According to the embodiment shown, there is a distance 14 between the edge of the conical bearing surface 6 and the radial faces 15 and 16 of the rim, in order to prevent contact corrosion from making an indentation on the disk rim.

The problem of preventing contact corrosion is compatible with a variant in which the conical bearing surface 6 is attached to the radial faces 15 and 16 of the rim by a bead, which would have the advantage of preventing stress concentrations.

Machining of conical bearings on the edges of the rim result in the creation of a stress coefficient which is very favorable to the behavior of the disk under stress, which reduces the risk of fatigue cracks on the edge of the rim.

The blade and its locking device are installed as described below.

The blade root 5 is slipped axially into the groove 3, allowing the part of the shank which has one of the grooves 7 or 8 to extend axially beyond one of the faces of the disk and the bearing. The locking part 9 is placed in the groove 3 in such a way that the blade 12 enters the slot 13. Then the blade root 5 is pushed into the slot until the locking part 9 touches the bearing surface 6. The tongues 10 and 11 of the blade 12 are then folded against the blade shank 5 in the direction towards the disk. Into the other groove 7 or 8 is slipped a second locking part 9 including blade 12, whereby the blade is held against the bearing surface. Lastly, the blade is locked in place by folding the tongues of the second locking part against the blade root 5.

The device designed with two movable locking parts allows assembly or dismantling of the blade from either face of the disk.

It must be noted that in the case of dismantling, each locking part 9 can be reused several times. Only the blade 12 must be changed for a new assembly. Thus, the only part which must be discarded is an inexpensive part, since it is simply a piece of flat, rectangular sheet metal.

According to another assembly method, one of the locking parts 9 is placed in a groove 7 or 8 of the blade shank 5 where it is held by the blade 12. The blade groove 5 is then pushed into the slot 3. The blade must then be inserted from a given face of the rotor disk.

When such a method of assembly or dismantling is acceptable, the locking part 9 can be permanently fixed in the groove 7 or 8 or can be formed by an extending part of groove 5 formed when the blade root is machined. Then the device has only one movable locking part.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United State is:

1. An axial locking arrangement for turbomachine blades having shanks mounted in axial first slots of a rotor disk, said first slots including means for radially locking said blades, said axial locking arrangement comprising:

at least one conical bearing surface formed on an axial rim of said rotor disk, the maximum radial position of said bearing surface being at least equal to a radius of a circumferential line passing through the bottom of said first slots;

a second slot in a lower surface of at least one end of each said shank, the length of each said second slot extending parallel to the plane of said disk when said shanks are mounted in said first slots;

locking means individually inserted in each said slot, each said locking means being formed of a piece shaped to be inserted in said second slot in a direction having a radial component and to bear against one said bearing surface and walls of said second slot when inserted in said second slot and when said shank is in said first slot; and means separate from said locking means for circumferentially fixing said locking means within said second slot.

2. The arrangement of claim 1, wherein each said second groove has a right angle section in the form of an isosceles right triangle, with one of the sides of the right angle parallel to a generatrix of one said conical bearings when said root is in said first groove.

3. The arrangement of claim 2 wherein said conical bearing surface forms an angle between 40° and 45° with respect to the plane of said rotor disk.

4. The arrangement of claim 2 wherein said locking means are each formed of a rectangular parallelpipedal part, and wherein said means for fixing said locking means includes a third longitudinal slot in a face of said locking means, said third slot holding a second blade.

5. The arrangement of claim 4 wherein said second blade is wider than said first slot whereby a first portion of said second blade extends from said first slot, wherein each said second groove includes a second slot extending parallel to a generatrix of one said conical supports when said root is in said first groove, and wherein said first portion of said second blade is inserted in said second slot when said locking means is in said second groove.

6. The arrangement of claim 2 wherein said disk includes at least one radial face and wherein each said bearing surface is spaced from one said radial face.

7. The arrangement of claim 2 wherein one said at least one locking means is formed integrally with said root.

8. The arrangement of claim 1 wherein said locking means are each formed of a rectangular parallelepipedal part, and wherein said means for fixing said locking means includes a third longitudinal slot in a face of said locking means, said third slot holding a second blade.

9. The arrangement of claim 8 wherein said second blade is wider than said first slot whereby a first portion of said second blade extends from said first slot, wherein each said second groove includes a fourth slot extending parallel to a generatrix of one said conical supports when said root is in said first groove, and wherein said first portion of said second blade is inserted in said second slot when said locking means is in said second groove.

10. The arrangement of claim 1 wherein said conical bearing forms an angle between 40° and 45° with respect to the plane of said rotor disk.

11. The arrangement of claim 1 wherein one said at least one locking means is formed integrally with said root.

12. The arrangement of claim 1 wherein said disk includes at least one radial face and wherein each said bearing surface is spaced from one said radial face.

* * * * *